United States Patent [19]

Despot et al.

[11] Patent Number: 4,854,233

[45] Date of Patent: Aug. 8, 1989

[54] PROTECTIVE DEVICE ON ROTARY PRINTING PRESSES

[75] Inventors: Janko Despot; Ulrich Krober, both of Offenbach am Main, Fed. Rep. of Germany

[73] Assignee: M.A.N. Roland, Offenbach am Main, Fed. Rep. of Germany

[21] Appl. No.: 869,320

[22] Filed: Jun. 2, 1986

[30] Foreign Application Priority Data

Jun. 1, 1985 [DE] Fed. Rep. of Germany ..... 3519648

[51] Int. Cl.[4] ..... B41F 5/00

[52] U.S. Cl. ..... 101/216; 100/53; 101/349; 292/338; 403/330

[58] Field of Search ..... 101/216, 351, 349; 292/338 X; 100/53; 403/330; 312/42, 138 R, 249, 251, 313, 315, 326, 327, DIG. 33

[56] References Cited

U.S. PATENT DOCUMENTS

| | | | |
|---|---|---|---|
| 1,221,528 | 4/1917 | Golding | 292/338 X |
| 2,327,672 | 8/1943 | Schweller | 312/315 |
| 2,527,278 | 10/1956 | Schemansky | 292/338 X |
| 3,959,859 | 6/1976 | Stern, Jr. et al. | 292/338 X |
| 4,173,092 | 11/1979 | Nakai | 292/338 X |

FOREIGN PATENT DOCUMENTS

| | | |
|---|---|---|
| 7304891 | 8/1974 | France . |
| 1455651 | 11/1976 | United Kingdom . |

*Primary Examiner*—David A. Wiecking
*Assistant Examiner*—Moshe I. Cohen

[57] ABSTRACT

A protective device for a printing press having a hinged protective cover with an automatic mechanical interlocking mechanism, which includes a fixed pawl on the press frame and a cooperating interlocking element which, by shifting its center of gravity, automatically engages in and disengages from a recess in the pawl as the cover is successively raised and lowered with respect to a latched open position.

5 Claims, 2 Drawing Sheets

PROTECTIVE DEVICE ON ROTARY PRINTING PRESSES

FIELD OF THE INVENTION

The present invention relates generally to a protective device for a rotary printing press and more particularly concerns a mechanical interlocking mechanism in conjunction with a protective cover therefor.

BACKGROUND OF THE INVENTION

Protective covers are used on rotary printing presses in order to cover large areas of danger zones, particularly where there are rotating machine parts, such as inking, transfer and impression rolls, which can cause injury to the operators. Such protective covers, however, must be disposed on the printing machines so as to be removable or hingeable to enable maintenance and adjustment work to be carried out. Industry and insurance standards therefore require such protective covers and electrical protection for the same, either to stop the machine or allow only certain machine functions once the protective covers have been removed or hinged open. Controlled mechanical interlocking mechanisms are provided to safeguard these switching and movement sequences, and the interlocking elements thereof interlock the protective covers in the open state. A mechanism of this general kind is disclosed in European Pat. No. P-0063 229 wherein the interlocking elements of the interlocking mechanism are in the form of a catch and associated bolts on the protective cover and are disposed on one side of the press.

The primary disadvantage of this known interlocking mechanism is that additional operations are required to control the movement of the interlocking elements, in this case the catch. Ease of use of the press is thus impaired, particularly if the printer is on one side of the press and the catch must be operated from the other side. There is also the risk of the interlocking mechanism being damaged in the event of an attempt to close the protective cover without previously disengaging the interlock, thus impairing the function of the interlocking mechanism.

OBJECTS AND SUMMARY OF THE INVENTION

The primary object of the invention is to cover the danger zones of a printing unit by means of a protective cover cooperating with a mechanical interlocking mechanism which automatically latches and unlatches the cover in a latched open position as the cover is manually opened past the latched position.

This problem is solved, according to the present invention, by a hinged flat protective cover in conjunction with a mechanical interlocking mechanism which consists of a fixed pawl on the machine frame and, cooperating therewith, a controlled interlocking element which by shifting its center of gravity automatically engages in and disengages from a recess in the pawl.

The advantages of the mechanism according to the invention are increased ease of operation of the press together with an improved functioning of the interlocking mechanism. The interlock mechanism of the invention is also simple and inexpensive to manufacture and maintain.

These and other features and advantages of the invention will be more readily apparent upon reading the following description of a preferred exemplified embodiment o the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Figure 4:
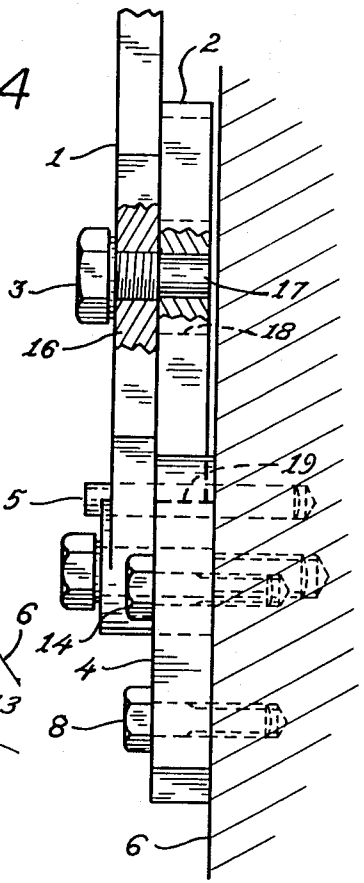
FIG. 4 is an enlarged fragmentary cross section of the interlock mechanism.
Figure 1:
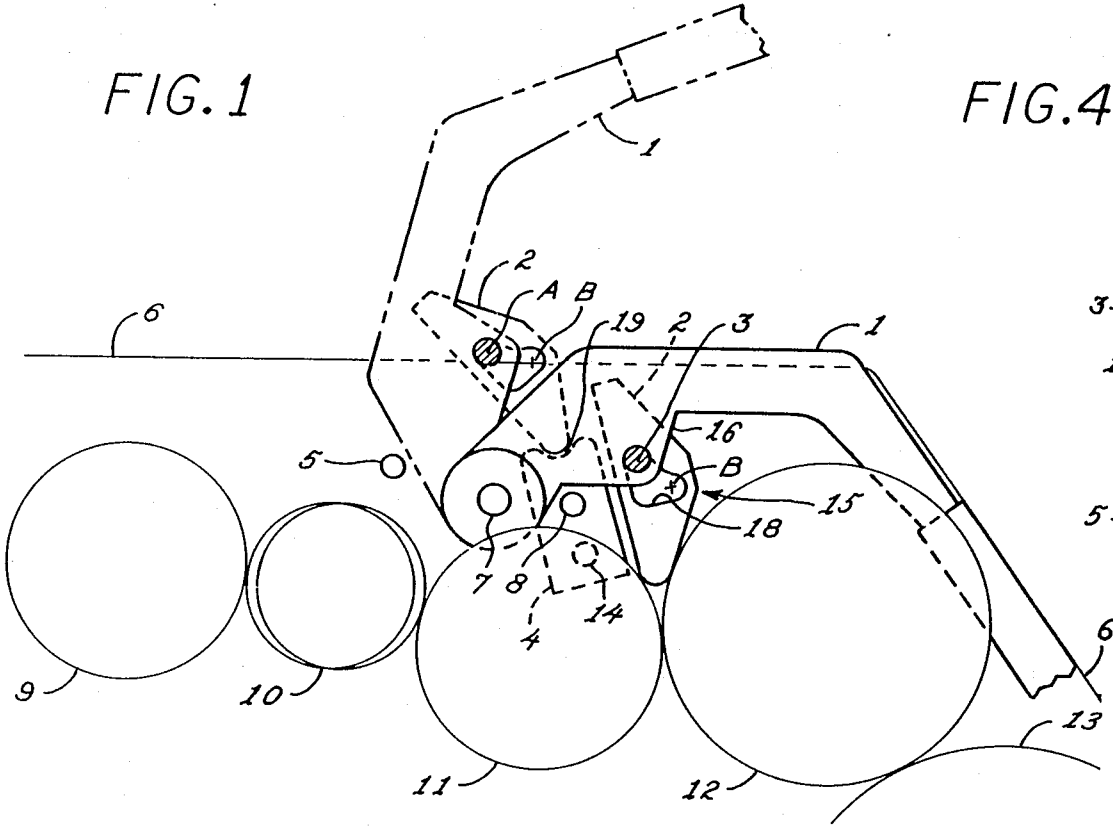
FIG. 1 is a fragmentary, schematic, side elevation view of the inking unit of a rotary printing press including the hinged protective cover and interlock mechanism according to the present invention with the cover and interlock in closed position shown in solid lines and in open position in dash lines.

Turning now to the drawings, a portion of a rotary printing press is shown having an inking unit operating from top to bottom with a large area over the inking rollers covered by a hinged protective cover 1. As shown in FIG. 1, the inking unit includes a duct roller 9, a vibrator 10 and a series of transfer rollers 11, 12 and 13 mounted in the press frame 6 beneath the protective cover 1.

In accordance with the invention, an interlock mechanism 15 is provided for the protective cover 1 which automatically latches and unlatches the cover in a latched open position as the cover 1 is manually opened past the latched position. To this end, an interlock element 2 is mounted on the protective cover 1 by means of a stud bolt 3 screwed into a depending ear 16 secured to the cover 1. As shown in the drawings, the bolt 3 has an unthreaded cylindrical tip portion 17 which is received in a generally L-shaped opening 18 located substantially in the center of the interlock element 2. The depending ear 16 is disposed in spaced-apart, parallel relation to a vertical surface of the press frame 6 and the interlock element 2 is mounted on the bolt tip 17 with swinging clearance between the ear 16 and frame 6.

When the protective cover is opened, it is swung upwardly about a pivot 7 as far as a stop pin 5. Both the pin 5 and pivot 7 are secured to the press frame 6. As shown in FIG. 1, the bolt tip 17 is disposed in a lobe A located at the end of the longitudinally oriented leg of the L-shaped opening 18 in the interlock element 2. Just before the cover 1 comes into contact with the stop pin 5, the trailing end of the interlock element enters a recess 19 in the upper end of a pawl 4 which is fixed to the press frame 6 by suitable means such as screws 8 and 14. When the protective cover 1 is released, it lowers slightly to a latched open position wherein the trailing end of the interlock element 2 engages the recess 19 in the pawl 4 and the bolt tip 17 moves to lobe B located at the end of the transverse leg of the L-shaped opening 18 in the interlock element. (See FIG. 2, solid line.)

Figure 2:
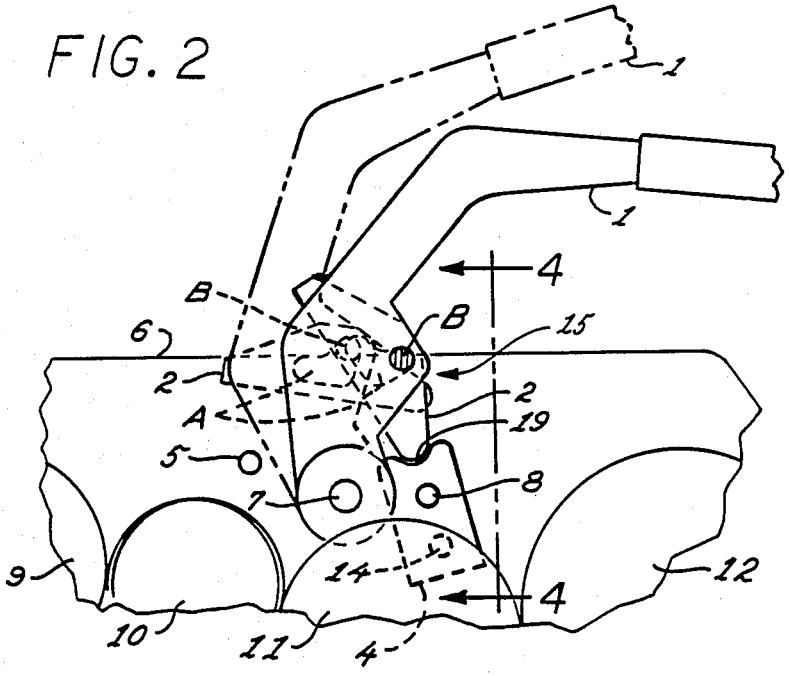
FIG. 2 is a fragmentary view similar to FIG. 1 with the cover and interlock in latched open position shown in solid lines and in unlocked open position in dash lines.

With the bolt tip 17 disposed in lobe B of the opening 18, the center of gravity of the interlock element 2 is located to the left of the bolt tip 17 as seen in FIG. 2 and the left-hand side of the interlock element is heavier than the right-hand side. If the protective cover is now briefly lifted, the interlock element 2 is drawn out of the recess 18 in the pawl 4 and because the center of gravity of the interlock element 2 is to the left of the bolt tip 17, the interlock element swings counterclockwise out of the recess 18 and the protective cover 1 can now be closed. (See FIG. 2 dash line.)

Figure 3:
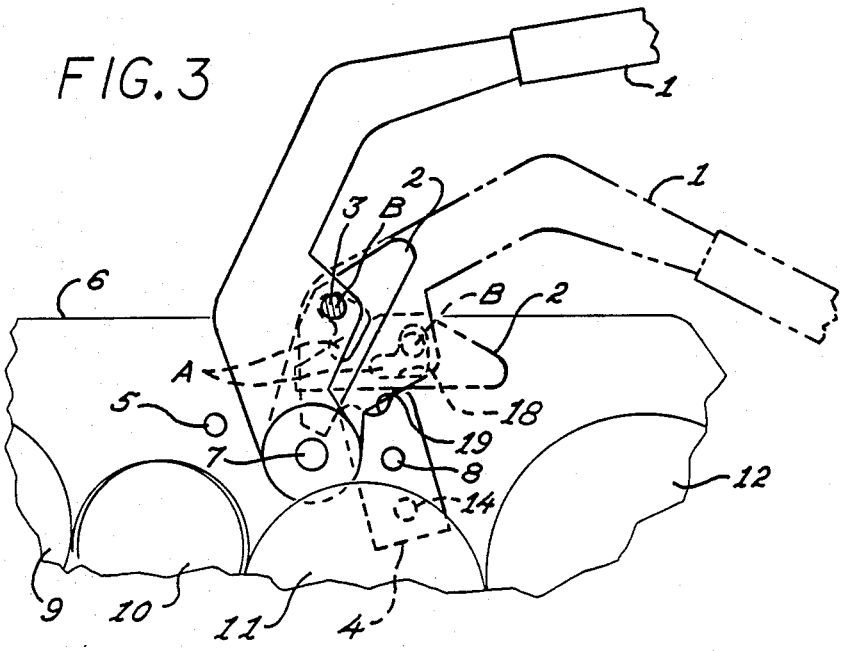
FIG. 3 is a fragmentary view similar to FIG. 1 with the cover and interlock in successively more closed positions shown in solid and dash lines, respectively.

As the cover 1 is lowered, the interlock element 2 engages the pawl 4 and is progressively rotated clockwise an shown in the solid and dash-line illustrations of FIG. 3. At the same time, the bolt tip 17 moves out of lobe B in the recess 18 and into lobe A as the interlock element 2 slides down the side of the pawl 4 to the solid line position shown in FIG. 1 with the cover 1 closed. It will be understood that the center of gravity of the interlock element 2 is now located to the right of the bolt tip 17 and the trailing end of the interlock element 2 is ready to enter the recess 18 in the pawl 4 when the cover is again opened as shown in dash lines in FIG. 1.

For simplicity of illustration only a single interlock mechanism 15 has been shown adjacent one side of the protective cover 1 and press frame 6. If desired, however, such an interlock mechanism 15 can be located on both edges of the cover 1, particularly if the cover is exceptionally wide, heavy or subject to sagging if only a single interlock mechanism is used. In either case, it will be understood that the cover can be opened, automatically latched, unlatched and closed by an operator positioned along either side of the press.

From the foregoing, it will be appreciated that the interlock mechanism 15 of the present invention is both reliable and easy to operate. It is also simple in construction and thus relatively simple and inexpensive to manufacture and maintain. To provide additional safety for the press operator and maintenance workers, the protective cover 1 may also be provided with electrical cut-off switches for turning off the press when the cover is opened as is well known in the art.

We claim as our invention:

1. A protective device for a rotary printing press comprising a protective cover hingedly connected to said press for pivotal movement between open and closed positions, a mechanical interlock mechanism associated with said protective cover for releasably maintaining said cover in an open position, said interlock mechanism including a pawl fixed to said press and an interlock element carried by said cover, pivot means on said cover upon which said interlock element is supported, said pawl being formed with an interlock element receiving recess, and means for shifting the center of gravity of said interlock element relative to said pivot means in response to raising and lowering of said cover to permit automatic positioning of said interlock element for engagement with said pawl recess when said cover is to be maintained in an open condition and to facilitate automatic disengagement of said interlock element from said pawl recess when said cover is to be closed, said interlock element being formed with a slot for receiving said pivot means, said pivot means being movable between opposite ends of said slot as an incident to raising and lowering said cover, the center of gravity of said interlock element being disposed on opposite sides of said pivot means as said pivot means is moved from one end of said slot to the other.

2. A protective device according to claim 1 in which said slot is an L-shaped opening.

3. A protective device according to claim 2 wherein said generally L-shaped opening is formed with a lobe at each end thereof and said interlock element swings by gravity in one direction when said pivot means is disposed in one of said lobes and in the opposite direction when said pivot means is disposed in the other of said lobes.

4. A protective device according to claim 2 wherein said generally L-shaped opening is oriented with one leg thereof generally longitudinal with respect to said interlock element and the other leg thereof generally transverse with respect to said interlock element.

5. A protective device according to claim 3 wherein said interlock element is disposed to engage and pivot around said pawl as said cover is lowered from its unlatched open position to its closed position.

* * * * *